US006179623B1

(12) United States Patent
Pei

(10) Patent No.: US 6,179,623 B1
(45) Date of Patent: Jan. 30, 2001

(54) ELECTRICAL SOCKET

(75) Inventor: Wen-Chun Pei, Taipei (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/342,330

(22) Filed: Jun. 29, 1999

(30) Foreign Application Priority Data

Aug. 19, 1998 (TW) ..... 87213621

(51) Int. Cl.[7] ..... H01R 12/00
(52) U.S. Cl. ..... 439/70; 439/83
(58) Field of Search ..... 439/70, 83, 876, 439/342

(56) References Cited

U.S. PATENT DOCUMENTS 3,602,875 * 8/1971 Pierini ..... 439/525
3,621,444 * 11/1971 Stein ..... 439/109
4,693,528 * 9/1987 Asick et al. ..... 439/83
5,834,848 * 11/1998 Iwasaki ..... 257/778

* cited by examiner

*Primary Examiner*—T. C. Patel
(74) *Attorney, Agent, or Firm*—Wei Te Chung

(57) ABSTRACT

An electrical socket comprises a dielectric base defining a plurality of receiving chambers therein, a number of terminals having a mating section and a soldering section, and a bottom board attached to the base. A dielectric cover is mounted to the base or is an integral part of the base for positioning pins of a mating integrated circuit (IC) chip. The bottom board is made of the same material as a mating circuit board. Thus, when the socket is soldered to the mating circuit board, misalignment between the terminals and the corresponding soldering pads of the mating circuit board is prevented due to identical coefficients of thermal expansion of the circuit board and the bottom board. The base forms a stand-off on a joining surface proximate the mating circuit board for distancing the bottom board from the base. Each terminal further comprises a curved section between the mating section and the soldering section for being disposed in a recess defined in a side wall of the corresponding receiving chamber of the base thereby cooperating with the stand-off to prevent molten solder from wicking into the receiving chambers. Thus, reliable communication quality between the mating IC chip, the socket and the mating circuit board can be achieved.

6 Claims, 3 Drawing Sheets

ELECTRICAL SOCKET

BACKGROUND OF THE INVENTION

The present invention relates to an electrical socket, and particularly to an electrical socket supporting an integrated circuit (IC) chip and being securely surface mounted to a circuit board thereby achieving reliable interconnection between the IC chip and the circuit board.

An integrated circuit chip is commonly mounted to an electrical socket which then is secured to a circuit board via soldered connections between contacts of the socket and the circuit board. At present, the soldering connections between a socket and a circuit board are usually achieved by surface mount technology (SMT) or through hole technology (THT). THT has become less frequently employed since the required through holes do not make an efficient use of space on a circuit board. SMT is used in a wide range of applications due to the small space requirement on a circuit board.

A conventional socket is disclosed in U.S. Pat. No. 5,746,608. Contacts of the socket are adapted to provide electrical connection between the socket and a circuit board.

Another conventional socket is shown in FIG. 3. An electrical socket assembly 8 comprises a dielectric base 80, a plurality of contacts 81, a circuit board 82 and a chip module 83. The base 80 defines a plurality of engaging slots 84 communicating with the receiving chambers 85. The contacts 81 are received in corresponding receiving chambers 85. One end 88 of each contact extends outside of the receiving chambers for being surface mounted to the circuit board 82 via a solder ball 86 attached thereto. The chip module 83 comprise a plurality of engaging terminals 87 extending into the receiving chambers 85 through the engaging slots 84 to electrically engage with the corresponding contacts 81. Electrical communication between the chip module 83 and the circuit board 82 is thereby achieved.

However, differences in coefficients of thermal expansion (CTE) between a socket and a corresponding circuit board cause problems in conventional surface mount connections. Misalignment between contacts of the socket and corresponding soldering pads of a mating circuit board caused by the CTE problem results in poor communication quality. Furthermore, in the second example discussed above, the solder balls 86 easily wick into the receiving chambers 85 when melted during the surface mount procedure thereby adversely affecting the quality of the connection. Therefore, an improved socket is required for eliminating the negative effects resulting from the CTE problem and for preventing solder from wicking into an interior of the socket.

BRIEF SUMMARY OF THE INVENTION

A main object of the present invention is to provide an electrical socket which can be securely surface mounted to a circuit board via a bottom board made of the same material as the circuit board thereby overcoming problems related to differences in CTE and achieving reliable communication quality.

A second object of the present invention is to provide an electrical socket which can eliminate negative effects resulting from the CTE problem thereby avoiding misalignment between contacts of an electrical socket and soldering pads of a mating circuit board.

A third object of the present invention is to provide an electrical socket having a dielectric base which can prevent solder from wicking into an interior of the base, thereby ensuring signal transmission quality.

In accordance with one aspect of the present invention, an electrical socket mainly comprises a dielectric base having a mating surface, a joining surface and a plurality of receiving chambers defined between the mating surface and the joining surface, a plurality of contacts received in the receiving chambers and a bottom board. Each contact comprises a soldering section and a mating section. The bottom board is made of the same material as a mating circuit board and is disposed between the base and the circuit board. A plurality of engaging apertures are defined in the bottom board for extension of the soldering ends of corresponding contacts therethrough to be soldered onto the mating circuit board. The present invention can overcome the negative effects resulting from the CTE problem because the soldering process occurs between the bottom board and the mating circuit board which have the same CTE.

The soldering section of each contact further forms a curved section which has two corners bent at an appropriate angle for preventing molten solder from wicking into the receiving chambers via the engaging apertures of the bottom board. Moreover, the base forms at least a stand-off projecting toward the bottom board for distancing the bottom board from the base thereby further preventing the molten solder from wicking into the receiving chambers of the base. A space is simultaneously provided for permitting slight deformations of the contacts due to reasons other than the CTE problem of the base and the mating circuit board.

Other objects, advantages and novel features of the invention will become more apparent from the following detailed description when taken in conjunction with the accompanying drawings.

DETAILED DESCRIPTION OF THE INVENTION

Figure 1:
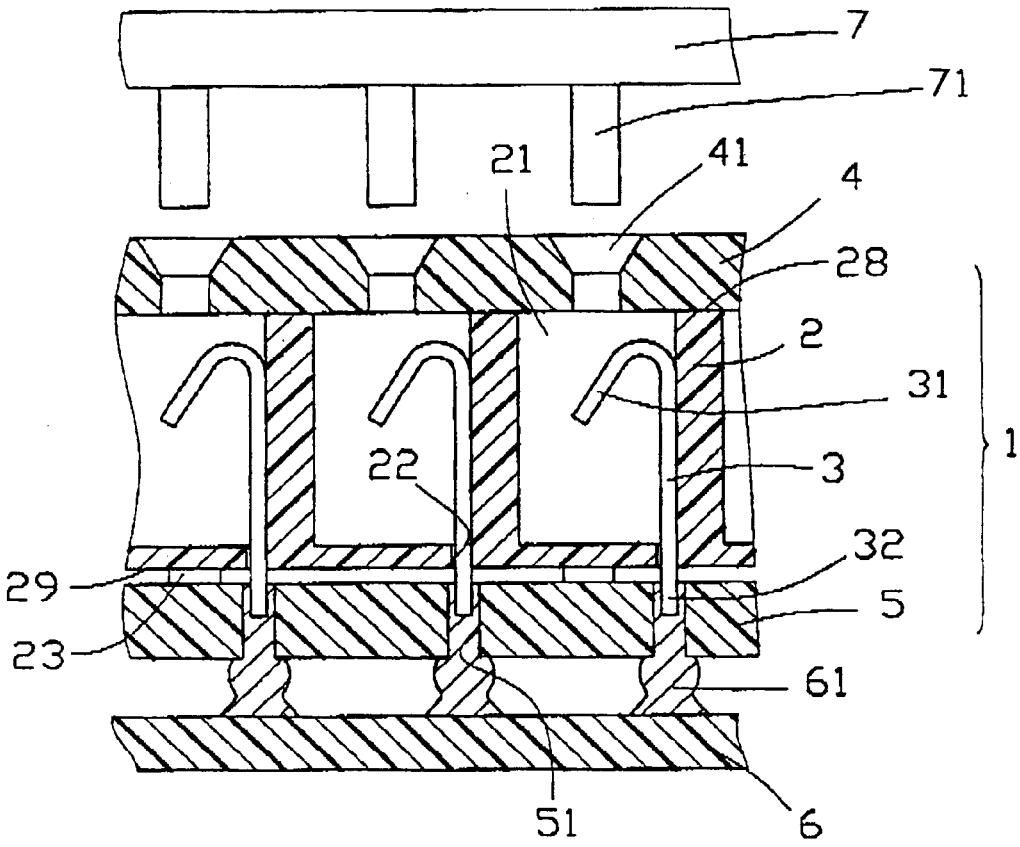
FIG. 1 is a sectional view of a first embodiment of an electrical socket in accordance with the present invention.

Referring to FIG. 1, an electrical socket 1 in accordance with the present invention comprises a dielectric base 2 having a mating surface 28 and a joining surface 29, conductive terminals 3 received in the base 2, a dielectric cover 4 and a bottom board 5 attached at the joining surface 29 of the base 2. The cover 4 is mounted to the mating surface of the base 2. The base 2 defines a plurality of receiving chambers 21 for receiving the terminals 3 therein. A plurality of engaging slots 22 are defined between the joining surface 29 and the receiving chambers 21. A stand-off 23 is outwardly formed on the joining surface 29 thereby distancing the bottom board 5 from the base 2 for preventing molten solder from wicking into the receiving chambers 21 via the engaging slots 22.

The terminals 3 are inserted into the receiving chambers 21 from the mating surface 28 of the base and are secured in the corresponding engaging slots 22. Each terminal 3 comprises a mating section 31 and a soldering section 32. The mating section 31 of each terminal 3 is substantially a resilient curved section for electrically contacting with a mating pin 71 of a mating integrated circuit (IC) chip 7 (or another kind of mating package), while the soldering section 32 of each terminal 3 forms latching means at appropriate positions thereof for engaging in the corresponding engaging slot 22 of the base 2 and extends beyond the joining surface 29 for being soldered to a mating circuit board 6.

The cover 4 defines a plurality of engaging apertures 41 therein for extension of corresponding pins 71 of the mating IC chip 7 therethrough. The cover 4 can be driven to move along the mating surface 28 of the base 2 by a cam (not shown) pivotably attached between the cover 4 and the base 2 thereby properly connecting the pins 71 of the mating IC chip 7 to the corresponding terminals 3.

The bottom board 5 defines a plurality of soldering holes 51 for extension of the soldering sections 32 of the corresponding terminals 3 therethrough for being soldered to the mating circuit board 6 via solder balls 61. The bottom board 5 is attached onto the joining surface 29 of the base 2 by fixing means which will place little effect on the present invention whereby a description of the fixing means is omitted herein.

Soldering of the socket assembly 1 to the mating circuit board 6 takes place between the bottom board 5 and the mating circuit board 6. Since the bottom board 5 is made of the same material as the mating circuit board 6, the coefficients of thermal expansion (CTE) of the two surfaces should be equal. Under the condition of a uniform temperature, the thermal expansion of the two surfaces should be the same, and therefore the solder therebetween should not be subject to large shear stress and misalignment of the terminals with the pads of the circuit board should not be a problem. The negative effects due to the CTE problem are eliminated.

When the electrical socket assembly 1 is soldered onto the mating circuit board 6, the solder balls 61 are positioned on a bottom surface of the bottom board 5 proximate the mating circuit board 6. The solder balls 61 are then melted and the molten solder flows into the soldering holes 51 thereby fixedly soldering the soldering sections 32 of the terminals 3 received in the corresponding soldering holes 51. Thus, the electrical socket assembly 1 is soldered onto the mating circuit board 6 and reliable electrical communication between the electrical socket assembly 1 and the circuit board 6 is established. The pins 71 of the IC chip 7 are then inserted into the corresponding engaging slots apertures 41 of the cover 4 and extend into the corresponding receiving chambers 21 of the base 2. When the cam pivotably drives the cover 4 to slide along the mating surface 28 of the base 2, the pins 71 contact the mating sections 31 of the corresponding terminals 3 thereby establishing electrical connection between the IC chip 7 and the electrical socket 1 and achieving electrical communication between the IC chip 7 and the circuit board 6.

Figure 2:
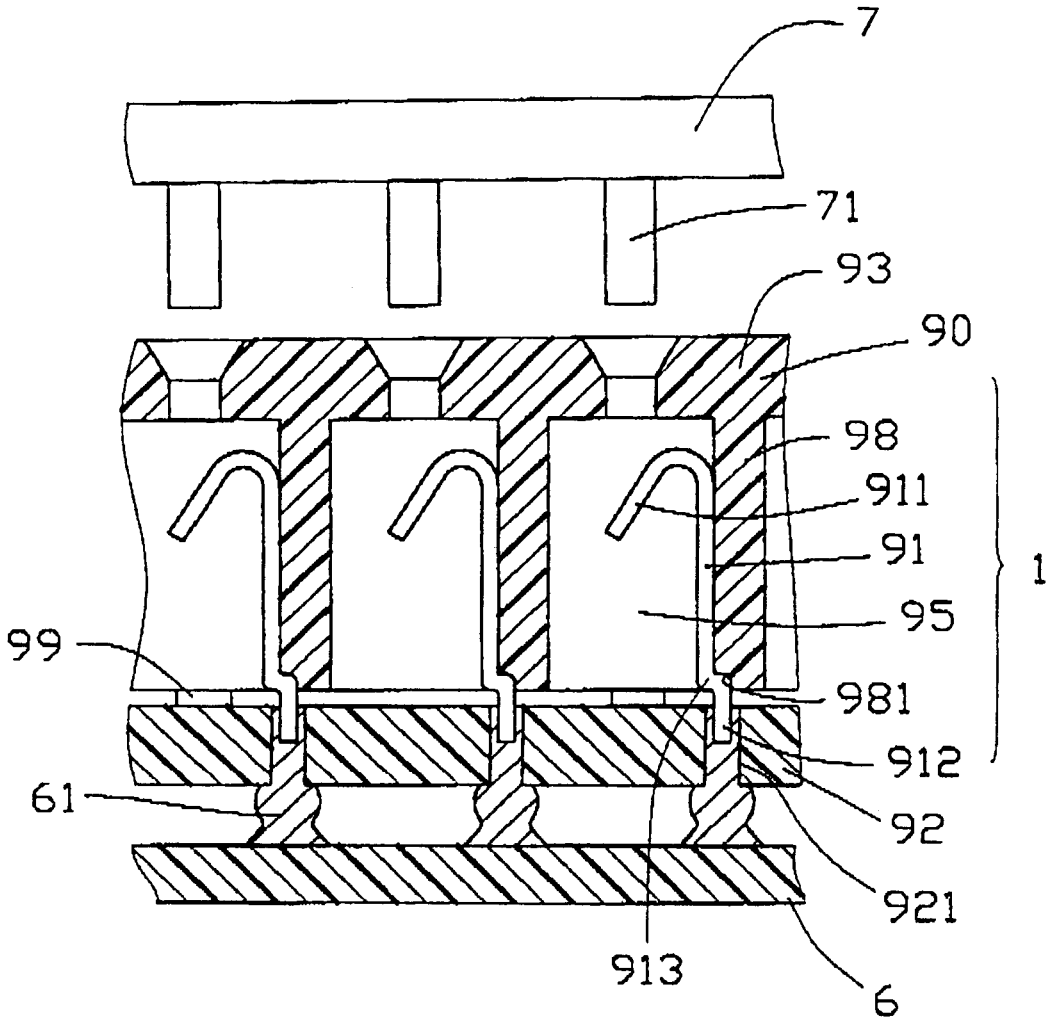
FIG. 2 is a sectional view of a second embodiment of an electrical socket in accordance with the present invention.
Figure 3:
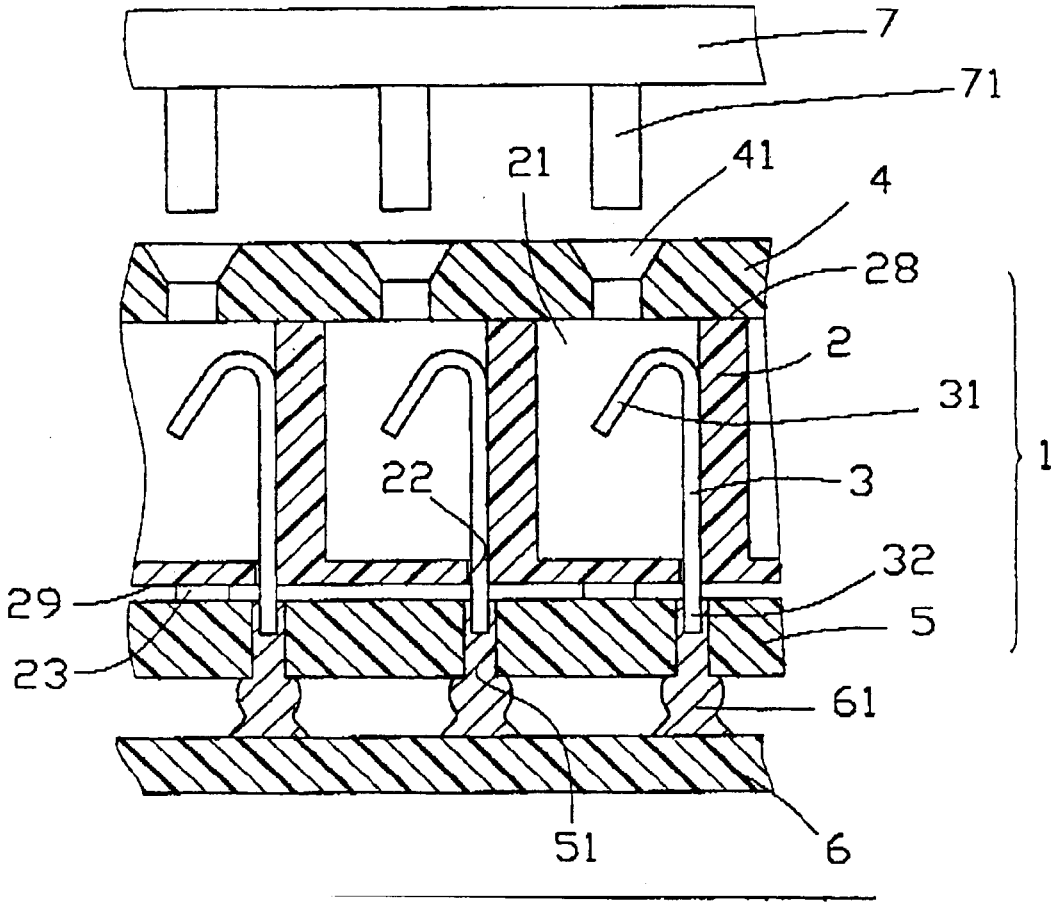
FIG. 3 (PRIOR ART)
FIG. 3 is a sectional view of a conventional electrical socket

Referring to FIG. 2, the electrical socket 1 of the second embodiment comprises a dielectric base 90, a dielectric cover 93, a plurality of terminals 91 and a bottom board 92, all having the same structure as described in the first embodiment, except that the cover 93 is an integral part of the base 90, and each terminal 91 further comprises a curved section 913 between the soldering section 912 and the mating section 911, and that the base 90 forms a recess 981 in an end of a side wall 98 of each receiving chamber 95 proximate the bottom board 92 corresponding to the curved section 913. Thus, after the socket 1 is assembled together, the curved sections 913 will be received in the corresponding recess 981 and abut against the corresponding side walls 98. Therefore, when the solder balls 61 are melted to flow into soldering holes 921 of the bottom board 92 and are soldered to the soldering sections 912 of the terminals 91, the curved sections 913 of the terminals 91 and stand-off 99 of the base 90 will effectively prevent the molten solder from wicking into the receiving chambers 95 of the base 90. Thus, reliable electrical communication between the mating circuit board 6 and the socket 1 or between the IC chip 7 and the circuit board 6 via the socket I can be successfully achieved without complications arising from the CTE or the solder wicking problem.

The soldering sections of the terminals can be designed to be received within the soldering holes of the bottom board or to outwardly extend from the soldering holes of the bottom board. Either designation will have no effect upon the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical socket for establishing an electrical communication between an integrated circuit (IC) chip and a circuit board, comprising:

a dielectric base having a mating surface, a joining surface and a plurality of receiving chambers defined between the mating surface and the joining surface;

a dielectric cover provided on the mating surface of the dielectric base for positioning pins of the integrated circuit chip therein;

a plurality of terminals received in corresponding receiving chambers, each terminal comprising a mating section for electrically contacting with a mating IC chip and a soldering section; and a bottom board having substantially the same coefficient of thermal expansion as the circuit board and being attached to the joining surface of the dielectric base, the bottom board defining a plurality of holes for extension of corresponding soldering sections of the terminals thereinto.

2. The electrical socket as claimed in claim 1, wherein each terminal further comprises a curved section formed between the mating section and the soldering section and wherein a recess is defined in a side wall of corresponding receiving chamber of the dielectric base for properly positioning the curved section of the terminal therein thereby preventing molten solder from wicking into the receiving chamber.

3. The electrical socket as claimed in claim 1, wherein the dielectric base forms a stand-off on the joining surface for distancing the bottom board from the dielectric base thereby preventing molten solder from wicking into the receiving chambers of the dielectric base.

4. The electrical socket as claimed in claim 1, wherein the dielectric cover is integrally formed with the dielectric base and defines a plurality of engaging apertures therein for guiding pins of the IC chip into corresponding receiving chambers of the dielectric base.

5. An electrical socket for establishing an electrical communication between an integrated circuit chip and a circuit board, comprising:

a dielectric base defining a mating surface and an opposite joining surface and a plurality of receiving chambers extending therebetween;

a plurality of terminals received within corresponding chambers, respectively, each of said terminals including a soldering section;

a bottom board having substantially the same coefficient of thermal expansion as the circuit board and attached to the joining surface of the base, said bottom board defining a plurality of holes receiving corresponding soldering sections of the terminals, respectively; wherein a plurality of stand-offs are positioned between the joining surface and the bottom board for anti-wicking.

6. An electrical socket for establishing an electrical communication between an integrated circuit chip and a circuit board, comprising:

a dielectric base defining a mating surface and an opposite joining surface and a plurality of receiving chambers extending therebetween;

a plurality of terminals received within corresponding chambers, respectively, each of said terminals including a soldering section;

a bottom board having substantially the same coefficient of thermal expansion as the circuit board and attached to the joining surface of the base, said bottom board defining a plurality of holes receiving corresponding soldering sections of the terminals, respectively; wherein each of said terminals defines a curved section received within a corresponding recess in each corresponding chamber for anti-wicking.

* * * * *